United States Patent [19]

Davis et al.

[11] 4,409,068

[45] Oct. 11, 1983

[54] INJECTOR FOR CALCINER

[75] Inventors: Richard L. Davis, Billings, Mont.; Harlan G. Graf; Don L. Edwards, both of Ponca City, Okla.

[73] Assignee: Conoco Inc., Ponca City, Okla.

[21] Appl. No.: 388,339

[22] Filed: Jun. 14, 1982

[51] Int. Cl.[3] ..... C10B 1/04; C10B 49/06

[52] U.S. Cl. ..... 202/85; 201/17; 202/95; 202/99; 202/215

[58] Field of Search ..... 202/85, 88, 93, 95, 202/99, 214, 215, 239, 270; 201/17, 34, 37; 239/132.3, 139; 432/99, 233

[56] References Cited

U.S. PATENT DOCUMENTS

| | | | |
|---|---|---|---|
| 2,595,366 | 5/1952 | Odell et al. | 201/17 |
| 3,260,514 | 7/1966 | Asano et al. | 432/99 |
| 3,620,455 | 11/1971 | Berry | 239/132.3 |
| 3,816,338 | 6/1974 | Corson | 201/34 |
| 3,855,071 | 12/1974 | Koppelman | 201/34 |
| 3,912,244 | 10/1975 | Chang | 239/132.3 |
| 4,022,569 | 5/1977 | Farago et al. | 432/14 |
| 4,053,365 | 10/1977 | Welter | 202/100 |
| 4,155,702 | 5/1979 | Miller et al. | 239/132.3 |
| 4,251,323 | 2/1981 | Smith | 201/29 |
| 4,274,587 | 6/1981 | Cioffi et al. | 239/132.3 |
| 4,309,270 | 1/1982 | Tyler et al. | 201/31 |

*Primary Examiner*—Bradley Garris

*Attorney, Agent, or Firm*—Stephen A. Littlefield

[57] ABSTRACT

Combustion gas such as air, oxygen-enriched air or oxygen is introduced at an intermediate level in a vertical shaft kiln for the calcining of petroleum coke using a plurality of radially disposed combustion gas injectors. The injectors include means for circulating coolant around the periphery of the injector so that common metals may be used in the high temperature (above 2000° F.) environment of the shaft kiln.

8 Claims, 3 Drawing Figures

INJECTOR FOR CALCINER

This invention relates to the art of shaft kilns and more particularly, to a water cooled combustion gas injector for use in a high temperature, vertical calciner for coke.

BACKGROUND OF THE INVENTION

The following comprises a prior art statement in accordance with the guidance and requirements of 37 CFR Sections 1.56, 1.97 and 1.98.

Petroleum coke is generally calcined at high temperature to drive off volatile hydrocarbons and moisture. The calcined product may be used to produce anodes for aluminum manufacture or, in cases where the delayed coke is needle-type, premium coke, the calcined product may be used for the manufacture of graphite electrodes for use in electric arc steel making processes.

Most present day commercial coke calciners are the inclined, rotary kiln type in which the coke is tumbled in a high temperature atmosphere. Such a process requires a large amount of fuel to heat the kiln and there are large heat losses involved in this process. The operation of this type of rotary calciner is described in U.S. Pat. Nos. 4,022,569 and 4,053,365.

Another type of calciner used for calcining delayed petroleum coke is described in U.S. Pat. No. 4,251,323. The coke is calcined in an internally fired, vertical shaft kiln. In this kiln, a moving bed of particulate material flows downwardly through the kiln and is preheated to calcining temperature and substantially devolatilized in the upper section by hot gases moving upwardly through the kiln. Combustion gas such as air, oxygen or oxygen-enriched air is introduced into a combustion zone where combustible components of a recycle gas, as well as some of the particulate material are burned. Combustion gases plus unburned recycle gas heat the downwardly moving bed of material to calcining temperatures in a calcining zone. The upwardly flowing gases preheat the incoming particulate material in the area above the calcining zone. Kiln off gases containing fines and volatile material in the form of vapor and/or mist are subjected to fines removal and scrubbing with the product being a low heat value product gas comprising carbon monoxide, hydrogen and low molecular weight hydrocarbons. A portion of this product gas is injected into the lower end of the kiln as recycle gas. The upwardly moving recycle gas (prior to combustion) cools the calcined material moving downwardly from the combustion zone so that the calcined product leaving the kiln is somewhat cooled and can be readily handled.

In the internally fired vertical shaft kiln of the aforementioned U.S. Pat. No. 4,251,323, combustion gas is injected into the kiln in the combustion zone through a series of water cooled conduits which are positioned transverse to the vertical cylindrical axis of the kiln. While this arrangement of injector tubes provides for good distribution of combustion gas, the presence of transverse bodies in the shaft kiln restricts the downward flow through bridging of the particulate carbonaceous material which is being calcined. Further, there is significant heat loss through absorption of the combustion heat by the coolant in the injector conduits. Such heat loss impairs the efficiency of the kiln since a greater amount of particulate material must be burned to raise the temperature to calcining temperature for the petroleum coke, generally in the range of 2000° F. to 3000° F., preferably above 2400° F. At such temperatures it is necessary to cool the injector conduits since the use of high temperature resistant metals would be impractical from a cost standpoint for this application and the use of mild steel without cooling would quickly result in failure of the injector conduit. Processing at these temperatures is difficult in a shaft kiln unlike the retorting of oil shale in which such high temperatures and such critical control of such temperatures are not necessary.

In order to attain the required very high temperatures, above 2000° F. in a large shaft kiln, it is necessary to provide heat uniformly through the cross-section of the kiln. Attempts to calcine petroleum coke in shaft kilns have been made utilizing externally fired kilns wherein the heat is generated in an annulus outside the coke containing vessel. This is not practical with a large, commercially-sized operation because of heat transfer problems. Attempts to calcine petroleum coke in electrically heated furnaces have also been unsuccessful on a commercial basis. Thus, in order to utilize the advantages of a shaft kiln on a large scale operation, it is necessary to use an internally fired kiln in which combustion gas is injected into an intermediate section of the kiln for combustion of recycle gas and coke to provide the necessary heat. The primary problem with development of an internally fired shaft kiln for calcining petroleum coke is in the provision of a combustion gas distributor which will tolerate the high temperatures necessary. Merely using a metal pipe grid such as is done in retorting of oil shale is not satisfactory, as the metals will not support the load of the coke bed at the temperatures involved.

SUMMARY OF THE INVENTION

The present invention provides for an injector for distributing combustion gas in a vertical, internally fired shaft kiln for the calcining of petroleum coke. The injector of this invention provides for adequate distribution of combustion gas as well as allowing the use of metal injectors which are cooled so as to avoid problems at the high temperatures involved in the shaft kiln while not providing a heat drain which would lower the efficiency of the process.

In accordance with the invention, an internally fired vertical shaft kiln for the calcining of petroleum coke is provided with a plurality of combustion gas injectors which project inwardly of the outer walls of the kiln and terminate within the inner, refractory walls of the kiln. Each of the combustion gas injectors is provided with water jacketing and internal means for directing the flow of coolant such as water to maintain the temperature of the metal injector at an acceptable level.

Further in accordance with the invention, each of the aforementioned injectors is surrounded by a layer of refractory material which insulates the water jacketing from the absorption of process heat thereby avoiding heat losses which decrease kiln efficiencies.

Still further in accordance with the invention, each of the aforementioned combustion gas injectors is fed with combustion gas and coolant from common gas and coolant manifolds surrounding the vertical shaft kiln.

It is therefore an object of this invention to provide a combustion gas distribution apparatus which provides even distribution of combustion gases in a vertical shaft kiln.

It is a further object of this invention to provide a combustion gas injection apparatus which does not protrude into the interior of the shaft kiln so as to cause bridging of the vertically moving bed of material within the kiln.

It is yet another object of this invention to provide combustion gas distribution system which utilizes common metal components with fluid cooling such that the coolant does not consume process heat thereby lowering the efficiencies of the internally fired vertical shaft kiln process.

BRIEF DESCRIPTION OF THE DRAWINGS

These and other objects of the invention will appear through the understanding of a more detailed description of the invention which will be described hereinafter as a preferred embodiment thereof and illustrated in the accompanying drawings forming a part of this specification and in which.

DETAILED DESCRIPTION OF THE PREFERRED EMBODIMENT AND THE DRAWINGS

Figure 1:
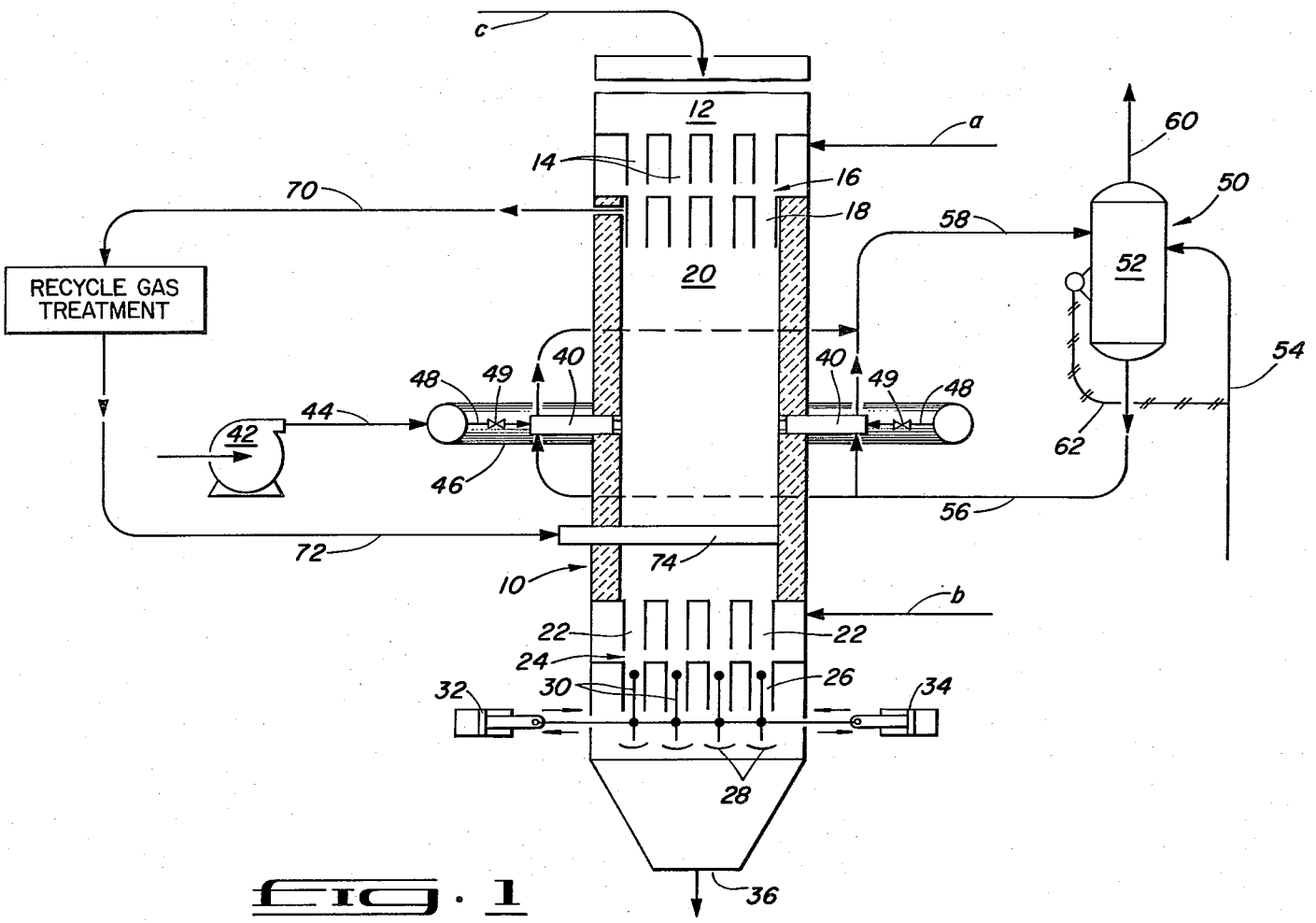
FIG. 1 is a schematic, cross-sectional view of an internally fired vertical shaft kiln for the calcining of petroleum coke in which the gas injectors of the invention are utilized.

Referring now to the drawings wherein the showings are for the purposes of illustrating a preferred embodiment of the invention only and not for the purpose of limiting same, FIG. 1 shows an internally fired vertical shaft kiln 10 of the type described in the aforementioned U.S. Pat. No. 4,251,323. The shaft kiln 10 is preferably cylindrical in form, although other configurations are possible, and is provided at its upper end with a feed hopper 12. The feed hopper 12 is provided with a plurality of upper feed inlet spouts 14 feeding into an upper seal gas chamber 16 in which a seal gas is continuously injected as shown at arrow a. The seal gas is provided to maintain positive pressure within the seal gas chamber 16 to prevent the venting of combustion product gases from within the shaft kiln to the atmosphere. The seal gas also prevents oxygen from entering the top of the kiln where heated product gases may be ignited. The seal gas chamber 16 is further provided with a plurality of downwardly extending feed tubes 18 which extend into the calcining chamber 20 of the shaft kiln 10.

The lower portion of the shaft kiln has a plurality of upper discharge spouts 22 leading into a second, lower seal gas chamber 24 which is similarly fed with a seal gas as shown at arrow b. From the lower gas chamber 24, lower discharge spouts 26 lead downwardly to discharge trays 28. Wiper blades 30 actuated by pistons 32 and 34 remove the coke from the trays 28 uniformly to maintain uniform flow from the kiln. Cooled, calcined product is within from the bottom of the kiln 36.

In the operation of the kiln, particulate material is fed into the feed hopper 12 at the top of the furnace as shown at arrow c. The particulate material passes downwardly through the feed inlet spouts 14, through the seal gas chamber 16 and through the lower feed tubes 18 into the interior of the calcined chamber 20 of the kiln 10. Once the charge in the kiln is preheated to operating temperature, the procedure for which will not be herein discussed since it is well known by those skilled in the art, the charge is self-sustaining with respect to the generation of heat so long as sufficient combustion gas is provided.

In this regard, combustion gas is provided to the kiln through a plurality of injectors 40 to be more fully described hereinafter. For the purposes of this specification, the term "combustion gas" will be understood to mean a gas which supports the combustion of combustible materials. In this regard, combustion gas may, therefore, be air, oxygen-enriched air and pure oxygen.

Combustion gas is fed to the injectors 40 through a system beginning at a blower 42 which, in the preferred embodiment, feeds combustion gas through a combustion gas line 44 to a torodial combustion gas manifold 46 disposed around the exterior of the shaft kiln 10. Although a toroidal manifold 46 is shown, it will be understood that any similar combustion gas distribution system may be provided such as plenum chamber. Alternatively, an individual blower unit may be provided for each injector 40. Combustion gas is fed to the individual injectors 40 through an inlet line 48, which may include a valve 49 for purposes of flow balance, to provide combustion gas to the calcining process within the shaft kiln 10.

In order to maintain the combustion gas injectors at an acceptable low temperature, a coolant recirculation system generally designated as 50 is provided. The coolant recirculation system 50 may be of any type such as a pass-through system in which the coolant is discharged as waste or, as preferred and shown in FIG. 1, a recirculating system in which the coolant is reused in a closed loop system.

The coolant system 50 comprises a coolant tank 52 which is fed with makeup coolant through a feed line 54. Injector coolant is provided to each of the injectors 40 through a coolant inlet line 56 where it passes through the internal passages of the injectors 40, as will be further described hereinafter, and is returned to the coolant tank 52 by a return line 58 where the coolant is processed to remove heat such as by aeration. Any steam produced by the coolant closed loop system is vented through vent line 60, the coolant level in the tank 52 being maintained by coolant additions through the feed line 54 and leveling in a return line 62.

It will be understood that other coolant systems may be provided, the important feature being that the coolant passes through the combustion gas injectors 40. The coolant may be any fluid common to the art such as air or, preferably, water. When water is the coolant used, appropriate additives may be provided for corrosion inhibition and the like which are common in the art.

The combustion and calcining processes taking place within the charge of the shaft kiln 10 produces a considerable amount of gas. The off gas comprises shield gas (generally $CO_2$ and nitrogen), volatilized hydrocarbons, and particulate coke fines, as well as combustible gaseous materials such as hydrogen, carbon monoxide and low molecular weight hydrocarbons. These combustion off gases are taken from the top of the shaft kiln through a recycle gas outlet line 70 for recycle gas treatment. The aforementioned U.S. Pat. No. 4,251,323 fully describes the treatment of recycle gas. Recycle gas treatment includes removal of fines through cyclonic treatment, scrubbing to cool the gas and remove condensible hydrocarbons and returning a portion of the recycle gas to the lower part of the kiln 10 through a recycle gas return line 72. Excess off gas constitutes a low heat value product gas which may be used for processes other than those directly associated with the operation of the kiln 10.

Recycle gas is fed through the recycle gas return line 72 to an injector 74 which does not form part of this invention and is shown generally as a horizontal bar injector 74 in FIG. 1. It will be understood that any form of gas injector from any positioning generally in the bottom of the kiln 10 may be utilized.

In the operation of the kiln 10, recycle gas entering at the bottom of the kiln passes upwardly through the downwardly moving charge of coke. The recycle gas cools the calcined coke material which has passed downwardly below the combustion zone so that the temperature of the calcined coke is reduced significantly prior to its discharge from the bottom of the kiln 36. As the recycle gas passes upwardly, it passes into the zone wherein the combustion gas which preferably comprises air or oxygen-enriched air is injected. The heat of the kiln at that point ignites the recycle gas and a portion of the coke to sustain the heating process within the kiln.

In order to obtain a satisfactory calcined product, it is essential that the green petroleum coke be subjected to a calcining temperature of at least 2000° F. for a period of at least one hour. The calcining may take place at a temperature from about 2000° to about 3000° F. for a period of one to ten hours. Preferably, the green coke is subjected to temperatures above 2400° F. in a soaking zone (above the combustion zone) for at least two hours, and in some cases, particularly where the green coke has a high sulfur content, a temperature above 2600° F. for at least two hours is desirable. Most preferably, the coke is calcined at a temperature of from 2400° to 2800° F. for a period of two to five hours.

As stated previously, the combustion gas is injected in an area approximately halfway up in the calciner through a plurality of air injectors 40. The combustion gas injectors 40 are illustrated in their preferred orientation, that is, disposed radially around the periphery of the kiln to provide uniform combustion gas distribution. It will be understood, however that other orientations of the injectors 40 are possible within the scope of this invention.

Figure 2:
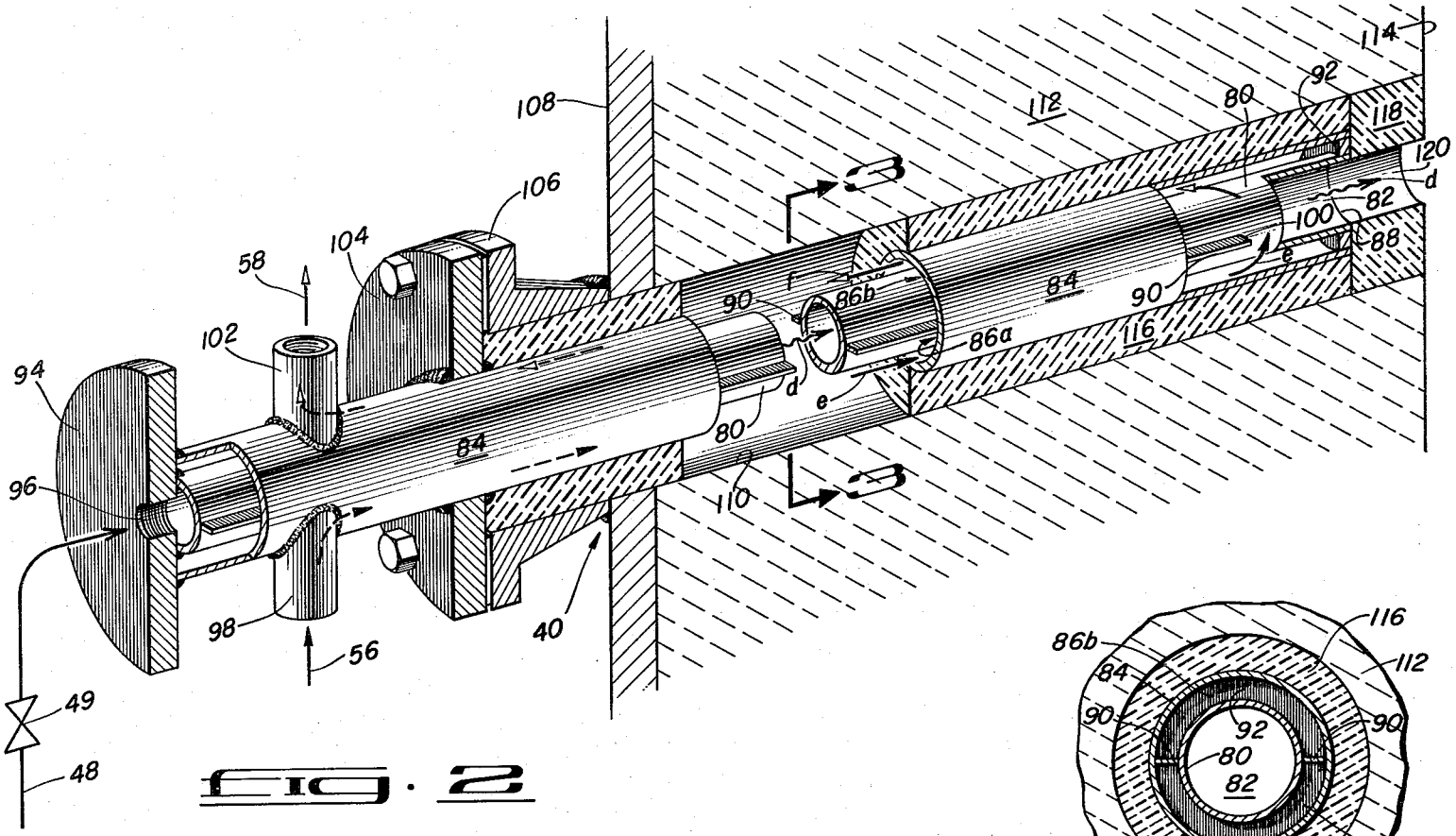
FIG. 2 is a fragmented perspective view of one combustion gas injector in accordance with a preferred embodiment of the invention.
Figure 3:
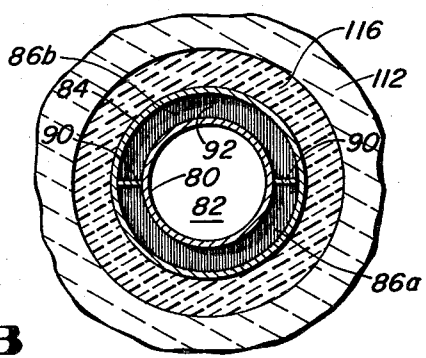
FIG. 3 is a cross-sectional view of the combustion gas injector shown in FIG. 2 taken along line 3—3 thereof.

As best shown in FIGS. 2 and 3, a single combustion gas injector 40 generally comprises a pair of coaxial tubular members in which the inner tubular member 80 defines a combustion gas passageway 82 through the interior thereof. A second, outer tubular member 84 defines an annular space 86 between its inner surface and the outer surface of inner tubular member 80. The annular space 86 is provided for the circulating flow of coolant such as water to keep the inner tubular member 80, and particularly its inward end 88 disposed near the interior of the kiln 10, at a relatively cool temperature.

The annular space 86 is divided by a pair of longitudinally disposed baffle walls 90 which divide the annular space 86 into a lower semi-annular space **86*a* and an upper semi-annular space 86*b***.

The annular space 86 is closed off at its inward end with a washer member 92 welded between the inner tubular member 80 and the outer tubular member 84. In a similar manner, a flange 94 having a central orifice 96 is welded to the outward end of both the inner tubular member 80 and the outer tubular member 84. Combustion gas is provided through the combustion gas conduit 48 to a fitting disposed in the flange orifice 96 with the combustion gas passing through the central combustion gas passageway 82 of inner tubular member 80 in the direction of the arrows d.

Coolant is provided through the annular space **86*a*, 86*b* through coolant the inlet line 56 connecting to a coolant inlet fitting 98 opening through the walls of the outer tubular member 84 into the lower semi-annular space 86*a*. It should be noted that the longitudinal baffle members 90 terminate within the annular space 86 short of the inward end 88 of the injector 40. This permits the flow of coolant in the direction of arrows e inwardly along the lower semi-annular space 86*a* to the inward end 100 of the longitudinal baffle walls 90 and return outwardly in the direction of arrows f through the upper semi-annular space 86*b* to an outlet fitting 102 which connects through the outer tubular member 84 to the coolant return line 58** as previously described.

In the preferred embodiment shown in the drawings, the combustion gas injector 40 is mounted substantially horizontally in the kiln 10 by bolting a flange 104 which is welded to the exterior wall of outer tubular member 84 to a corresponding flange 106 which is welded to the outer metal wall 108 of the kiln 10. A horizontal hole 110 is bored horizontally inwardly through the lining of refractory material 112 and to the interior wall 114 of the kiln 10. A sheath of refractory material 116 is provided between the outer wall of outer tubular member 84 and the wall of the bore hole 110 through the refractory material 112 to provide additional insulation against heat loss due to the coolant circulating through the combustion gas injector 40. In the preferred embodiment shown in FIG. 2, the injector 40 terminates at its inward end 88 radially outwardly of the inner wall 114 of the kiln 10. A castable refractory plug 118 having a central orifice 120 for combustion gas passage therethrough is provided to insulate the inward end 88 of the injector 40. The refractory plug 118 in conjunction with the refractory sheath 116 also prevent channeling of combustion gases through the refractory 112 which could result in failure of the kiln as a whole.

From the foregoing, it can be clearly seen that the present invention provides for an injector 40 for distributing combustion gas in a vertical, internally fired shaft kiln 10 for the calcining of petroleum coke. The injector 40 of this invention provides for adequate distribution of combustion gas as well as allowing the use of metal injectors which are cooled through a coolant passage 86 so as to avoid problems at the high temperatures involved in the processing in the shaft kiln 10 while avoiding heat losses which would lower the efficiency of the process.

The foregoing illustrates that, in accordance with the invention, an internally fired vertical shaft kiln 10 for the calcining of petroleum coke is provided with a plurality of combustion gas injectors 40 which project inwardly of the outer walls 108 of the kiln 10 and terminate within the inner, refractory walls 112 of the kiln 10. Each of the combustion gas injectors 40 is provided with water jacketing through a coolant passage **86*a*, 86*b* which includes internal means 90 for directing the flow of coolants such as water to maintain the temperature of the metal injector 40** at an acceptable level.

It has further been shown that each of the aforementioned injectors 40 is surrounded by a layer of refractory material 116 which insulates the water jacketing from the absorption of process heat thereby avoiding heat losses which decrease kiln efficiences.

It has also been shown that each of the aforementioned combustion gas injectors 40 is fed with combustion gas and coolant from common gas and coolant manifolds, 46 and 56, respectively, surrounding the vertical shaft kiln 10.

While the invention has been described in the more limited aspects of a preferred embodiment thereof, other embodiments have been suggested and still others will occur to those skilled in the art upon the reading and understanding of the foregoing specification. It is intended that all such embodiments be included within the scope of the invention as limited only by the appended claims.

Having thus described our invention, we claim:

1. In an internally fired, vertical shaft kiln for calcining petroleum coke comprising a vertical shaft kiln having a top and bottom and an outer wall and an inner refractory lining, means for providing green particulate petroleum coke to the top of said shaft kiln to provide a coke bed, means for removing calcined coke from said coke bed at the bottom of said shaft kiln and means for introducing recycle gas and combustion gas to the interior of said shaft kiln at an intermediate level in said coke bed, the improvement which comprises said means for introducing combustion gas comprising at least one tubular combustion gas injector having a longitudinal central orifice and extending through said outer wall and refractory lining and terminating at a point short of the interior surface of said refractory lining, said injector having an annular coolant circulation space disposed therearound and means for providing a coolant to said annular space.

2. The improvement as set forth in claim 1 further including a refractory sheath surrounding said combustion gas injector within said refractory lining.

3. The improvement as set forth in claim 1 wherein a plurality of said tubular combustion gas injectors extend radially inwardly through said outer wall and refractory lining.

4. The improvement as set forth in claim 3 wherein said plurality of tubular combustion gas injectors are substantially horizontally disposed.

5. The improvement as set forth in claim 3 wherein said plurality of tubular combustion gas injectors is fed with combustion gas from a common manifold.

6. The improvement as set forth in claim 1 wherein said annular coolant circulation space is divided by a pair of longitudinal baffles extending for a substantial portion of the length of said tubular combustion gas injector, said baffles forming two semi-annular coolant circulation spaces.

7. The improvement as set forth in claim 1 further including a castable refractory plug extending from the point of termination of said tubular combustion gas injector to the interior surface of said refractory lining, said castable refractory plug including a passage which is coaxial with said longitudinal central orifice of said tubular combustion gas injector.

8. In an internally fired, vertical shaft kiln for calcining petroleum coke comprising a vertical shaft kiln having a top and bottom and an outer wall and an inner refractory lining, means for providing green particulate petroleum coke to the top of said shaft kiln to provide a coke bed, means for removing calcined coke from said coke bed at the bottom of said shaft kiln and means for introducing recycle gas and combustion gas into the interior of said shaft kiln at an intermediate level in said coke bed, the improvement which comprises said means for introducing combustion gas comprising a plurality of horizontally disposed tubular combustion gas injectors having a longitudinal central orifice and extending radially inwardly through said outer wall and refractory lining and terminating at a point short of the interior surface of said refractory lining, said injectors each having an annular coolant circulation space disposed therearound and means for providing a coolant to said annular space.

* * * * *